United States Patent [19]

Nagashima

[11] Patent Number: 4,851,626

[45] Date of Patent: Jul. 25, 1989

[54] KEY SWITCH DEVICE

[75] Inventor: Takao Nagashima, Tokyo, Japan

[73] Assignee: Topre Corporation, Tokyo, Japan

[21] Appl. No.: 211,255

[22] Filed: Jun. 24, 1988

[30] Foreign Application Priority Data

Jun. 30, 1987 [JP] Japan ..... 62-100678[U]

[51] Int. Cl.[4] ..... H01H 1/10

[52] U.S. Cl. ..... 200/513

[58] Field of Search ..... 200/5 A, 86 R, 159 B, 200/340, 512, 513, 516

[56] References Cited

U.S. PATENT DOCUMENTS

| | | | |
|---|---|---|---|
| Re. 30,435 | 11/1980 | Fukao | 200/159 R |
| 3,932,722 | 1/1976 | Obata et al. | 200/159 B X |
| 4,127,758 | 11/1978 | Lowthorp | 200/159 B |
| 4,378,478 | 3/1983 | Deeg | 200/159 B |
| 4,390,765 | 6/1983 | Sado et al. | 200/159 B |
| 4,482,932 | 11/1984 | Hasegawa | 361/288 |
| 4,518,833 | 5/1985 | Watkins | 200/5 A |
| 4,584,444 | 4/1986 | Nagashima | 200/52 R |
| 4,604,509 | 8/1986 | Clancy et al. | 200/159 B X |
| 4,659,879 | 4/1987 | Hasegawa | 200/5 A |
| 4,677,268 | 6/1987 | Nemeth et al. | 200/159 B |

FOREIGN PATENT DOCUMENTS

| | | | |
|---|---|---|---|
| 54-29209 | 3/1979 | Japan . | |
| 2062965 | 5/1981 | United Kingdom | 200/159 B |
| 2092382 | 8/1982 | United Kingdom | 200/159 B |

*Primary Examiner*—J. R. Scott

*Attorney, Agent, or Firm*—Oblon, Spivak, McClelland, Maier & Neustadt

[57] ABSTRACT

A rubber spring is disposed on a base on which are mounted fixed electrodes. The rubber spring includes first and second cup sections. The first cup section is in the form of an inverted cup, whose top portion is smaller in diameter than the bottom portion thereof, and is adapted to be bent by a force applied thereto from above and to produce a resilient restoring force corresponding to the size of such deflection. The second cup section, which is located inside the first cup section, has a U-shaped longitudinal section and is adapted to be bent by a force applied thereto from above and to produce a resilient restoring force corresponding to such deflection. Thin-walled portions are formed at the bent portions of the first and second cup sections. A center projection protrudes upward from the center of the second cup section. The top face of the center projection is situated below the upper surface of the support seat. An electric conductor member is disposed on the central part of the underside of the second cup section, so as to face the fixed electrodes.

4 Claims, 5 Drawing Sheets

KEY SWITCH DEVICE

BACKGROUND OF THE INVENTION

1. Field of the Invention

The present invention relates to key switch devices adapted to be used in keyboards for operating computers, cash registers, electronic typewriters, and other electronic apparatuses.

2. Description of the Related Art

A key switch used in a keyboard is constructed such that when its key top is depressed by a user's finger, a conductor member therein touches fixed electrodes, thereby turning the switch on. Once the user's finger is removed from the key top, the key top is restored its original position by the resilience of a return spring.

Conventional key switches generally make use of metallic return springs. However, in U.S. Pat. No. 4,659,879, a key switch has been disclosed which uses a rubber spring, while Japanese Patent Disclosure No. 54-29209 discloses a key switch wherein a spongy elastic member is interposed between a rubber spring and a conductor member.

The key switch disclosed in U.S. Pat. No. 4,659,879 comprises a housing, an inverted-cup-shaped rubber spring located in the housing, a conductor member within the rubber spring, fixed electrodes placed opposing the underside of the conductor member, a plunger located above the rubber spring, and a key top mounted on the upper end of the plunger.

In the key switch containing the rubber spring, the rubber spring bends when the key top is depressed by a user's finger, so that the conductor member touches the fixed electrodes, thereby turning the switch on.

After the switch is turned on, the force of depression continues to act on the key top, by virtue of the force exerted by the user's finger. By this time, however, the fixed electrodes are already being touched by the conductor member, with the result that the rubber spring ceases moving.

The distance from the point corresponding to the instant the conductor member touches the fixed electrodes to the end of the stroke is what is called the over-stroke. For reason of user operability, the over-stroke of a key should preferably be 0.9 mm or more. Conventional key switches, however, often have an overstroke as short as about 0.5 mm. As a result, the key touch is often so dull that the operator cannot always be sure that completion of the switching operation has been achieved, and must therefore consciously determine whether or not the switching operation has been completed, throughout the time he or she is operating the keyboard. Such a conscious effort inevitably results in the operator quickly becoming tired and diminishing his/her work efficiency. This problem requires a solution which cannot be provided by the use of the rubber spring disclosed in Japanese Patent Disclosure No. 54-29209.

SUMMARY OF THE INVENTION

Accordingly, the object of the present invention is to provide a contact type key switch device wherein each key top has sufficient over-stroke after the switch has been turned on, in order that an operator can be sure that completion of the switching operation has been achieved and is not tired after operating the keyboard.

In order to achieve the above object, a key switch device according to the present invention comprises: a base formed of electric insulating material; fixed electrodes disposed on the base; a housing mounted on the base; a rubber spring formed of an integral elastomeric molding and contained within the housing, the rubber spring including a first cup section in the form of an inverted cup having a top portion, a first bent portion, and a bottom portion, which is larger in diameter than the top portion, the first cup section being adapted to be bent by a force applied thereto from above, and to produce a resilient restoring force which increases until the first cup section is bent to a predetermined degree, and which begins to decrease as the first bent portion is bent, a ring-shaped support seat located at the top portion of the first cut section, a second cup section, disposed inside the first cup section so as to be continuous with the support seat and having a U-shaped longitudinal section, the second cup section being adapted to be bent by a force applied thereto from above and to produce a resilient restoring force, and a center projection, protruding upward from the second cup section and having a top face situated below the support seat, being at the same level as the support seat when the second cup section is bent to a predetermined degree; an electric conductor member, disposed on the second cup section so as to face the fixed electrodes; a plunger supported by the housing, for vertical movement, and having a portion in contact with the support seat of the rubber spring, and adapted to contact the center projection when the second cup section is bent to a predetermined degree; and a key top mounted on the plunger.

When the key top of the key switch device of the invention is depressed by a user's finger, the first cup section is bent, thus gaining a resilient restoring force. When the first cup section is bent further, the resilient force of the first cup section increases to a maximum. Thereafter, the reaction to the key top decreases as the stroke of the key top further increases. When the conductor member of the key top at last touches the fixed electrodes, the switch is turned on. If the key top is then depressed further, the second cup section bends in turn, whereupon the key top lowers so that the bottom of the plunger abuts against the center projection of the second cup section.

According to the present invention, an over-stroke, which extends from the switch-on point to the end of the stroke, can be made longer than in the case of the prior art, so that the key can be operated reliably, resulting in reduced operator fatigue. After the switch is turned on, moreover, the conductor member is kept in contact with the fixed electrodes, by virtue of the constant pressure created by the resilience of the second cup section, so that the electrical output can be prevented from fluctuating in the switch on-off boundary region.

DETAILED DESCRIPTION OF THE PREFERRED EMBODIMENTS

Figure 1:
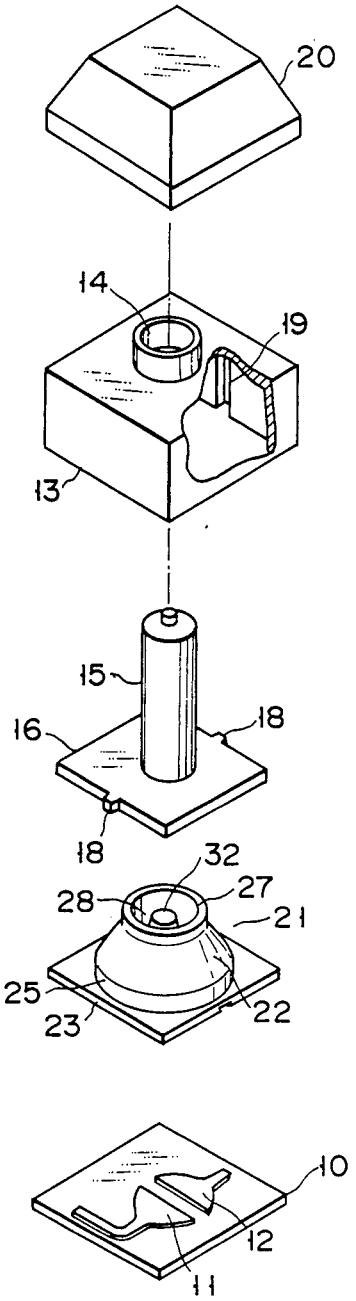
FIG. 1 is an exploded perspective view of a key switch device according to a first embodiment of the present invention.

Referring now to FIGS. 1 to 7, a first embodiment of the present invention will be described in detail.

A pair of fixed electrodes 11 and 12 are mounted on the upper surface of planar base 10, which is formed of electric insulating material, and are spaced horizontally thereon. Housing 13 is located over base 10, the top wall of housing 13 having vertical through hole 14, through which plunger 15 is passed. Plunger 15 has plate section 16 at its lower end, and key top 20 fixed to its upper end. A pair of projections 18 are formed one on each side of section 16, and are slidably fitted in corresponding vertical guide grooves 19 which are formed on the inner surface of housing 13, thereby enabling plunger 15 to move vertically with respect to housing 13.

Inside housing 13, rubber spring 21 is disposed between base 10 and plunger 15. Spring 21, which is an integral elastomeric molding, is provided with first cup section 22 having a shape such that it can be elastically deformed when a force is applied thereto from above. Cup section 22 is in the form of an inverted cup whose top portion is smaller in diameter than the bottom portion thereof, and has an open end on its bottom side. Flange 23 is provided at the open end of the first cup section.

Figure 7:
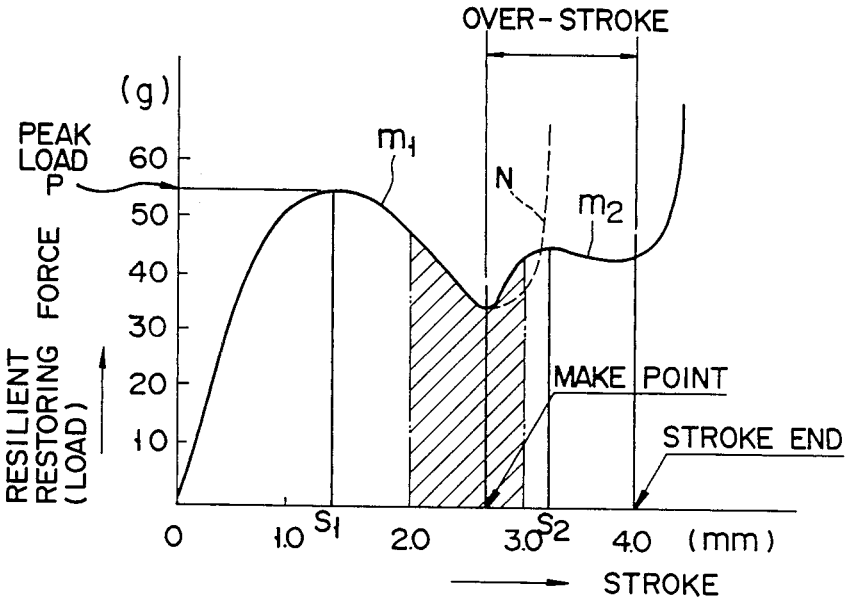
FIG. 7 is a graph showing the relationship between the load and deflection of the rubber spring shown in FIG. 1.

As is shown in FIG. 7, first cup section 22 has a characteristic whereby its resilient restoring force or load increases until predetermined deflection s1 is obtained, and whereby its first bent portion 25 bends to reduce the resilient restoring force when peak load P is exceeded, as indicated by curve m1 in FIG. 7.

Ring-shaped support seat 27 is formed at the upper end of first cup section 22. The upper surface of seat 27 is in contact with the lower surface of plate section 16 of plunger 15.

Figure 2:
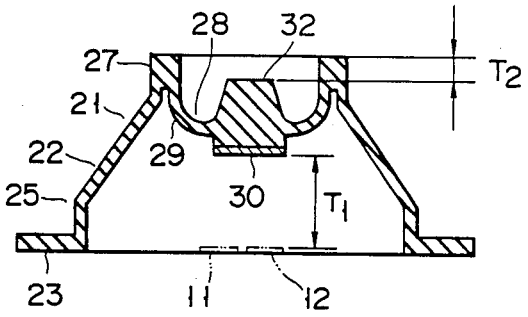
FIG. 2 is a longitudinal sectional view of a rubber spring shown in FIG. 1.
Figure 3:
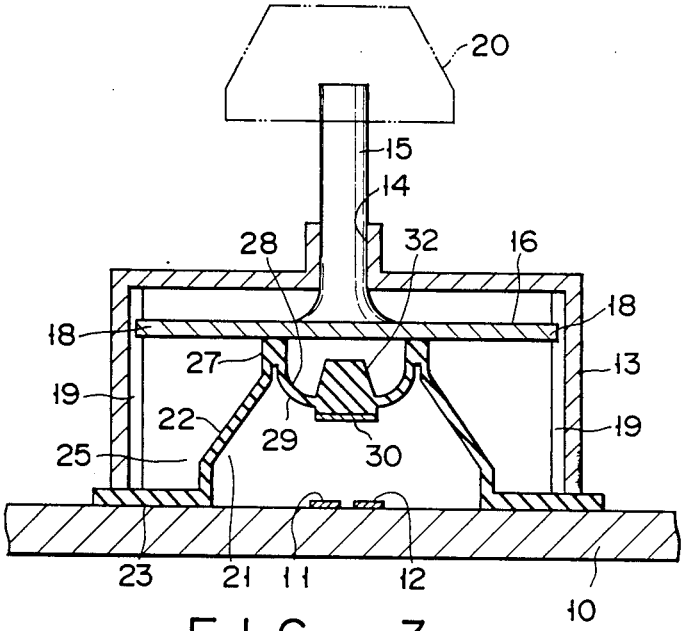
FIGS. 3 to 6 are sectional views showing different operating states of the key switch device shown in FIG. 1.

As is shown in FIG. 2, second cup section 28, having U-shaped longitudinal cross section, is formed inside support seat 27 and can also be elastically deformed when a force is applied thereto from above. SEcond cup section 28 has a characteristic whereby its resilient restoring force increases until predetermined deflection s1 in FIG. 7 is obtained, and whereby its second bent portion 29 bends to reduce the resilient restoring force when deflection s2 is exceeded, as indicated by curve m2 in FIG. 7.

Electric conductor member 30 is attached to the center of the lower surface of second cup section 28, so as to face fixed electrodes 11 and 12. Member 30 is formed of, for example, electrically conductive rubber or metal. When rubber spring 21 is free, as shown in FIG. 2, distance T1 from conductor member 30 to electrodes 11 and 12 preferably ranges from 2.0 to 3.0 mm. In the present embodiment, this distance is given by T1=2.5 mm.

Central projection 32 is formed in the center of the upper surface of second cup section 28. The top face of projection 32 is situated at a height lower, by margin T2, than the top level of support seat 27, (in this embodiment, T2 is 0.9 mm) and is adapted to be in contact with plate section 16 of plunger 15.

The following is a description of the operation of the aforementioned key switch device.

Figure 4:
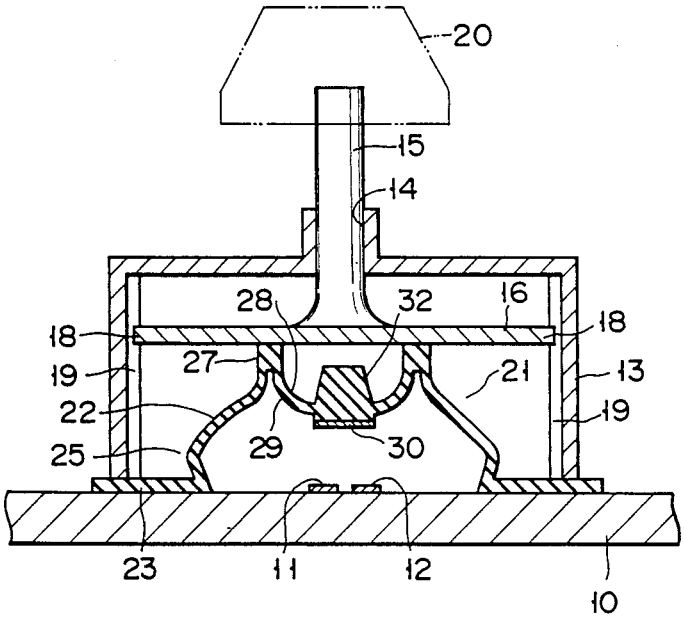
Figure 5:
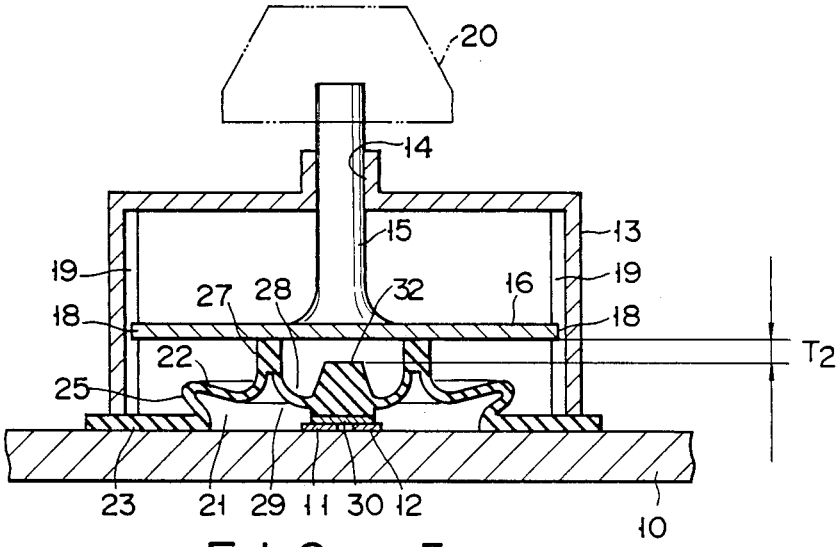

When key top 20 is depressed by a user's finger, the force of depression is applied to support seat 27 of rubber spring 21 via plunger 15. Thereupon, only first cup section 22 bends at the initial stage, as shown in FIG. 4. As the deflection increases, so does the resilient restoring force of cup section 22. When first cup section 22 attains predetermined deflection s1 (see FIG. 7), first bent portion 25 bends, thereby reducing the resilient restoring force of cup section 22. If key top 20 is depressed further, conductor member 30 touches fixed electrodes 11 and 12, thereby connecting the same, as shown in FIG. 5. This instant corresponds to a make point. At this make point, the deflection is set between 2.0 and 3.0 mm, as indicated by hatching in FIG. 7.

Figure 6:
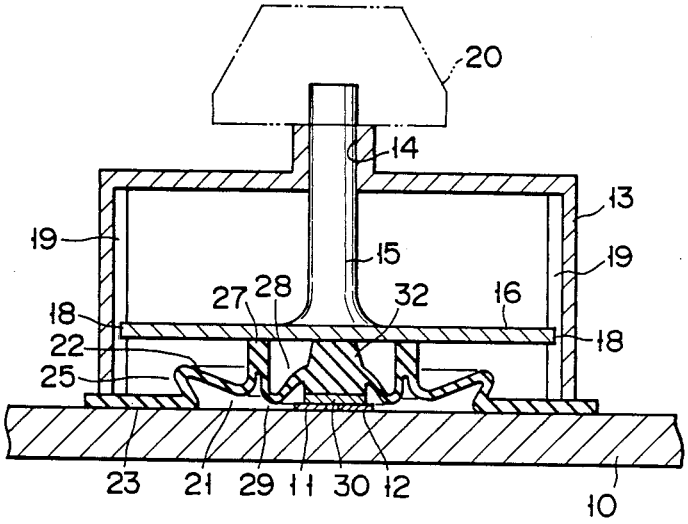

After fixed electrodes 11 and 12 are brought into contact with conductor member 30, the force of depression continues to act on support seat 27, by virtue of the force exerted by the user's finger. Accordingly, second cup section 28 bends, so that seat 27 goes on lowering. Thus, the resilient restoring force of rubber spring 21 increases. When predetermined deflection s2 is attained, second bent portion 29 bends, thereby reducing the resilient restoring force of cup section 28. If key top 20 is depressed further, plate section 16 abuts against center depression 32, as shown in FIG. 6. When spring 21 is compressed by about 0.5 mm, top 20 ceases to move. If, at this point, the user's finger is removed from key top 20, plunger 15 and top 20, along with conductor member 30, will rise to their original positions.

In the key switch device of the present embodiment, peak load P is 55 g, the make point is 2.6 mm, and the over-stroke is 1.4 mm. In comparison, the over-stroke of the prior art key switch is only 0.5 mm, as indicated by broken line N in FIG. 7.

According to the key switch device of this embodiment, a satisfactory over-stroke can be secured, so that the force of inertia of the finger's depression can be absorbed. As a result, an operator can continue key operation over a prolonged period, with less fatigue. An optimum over-stroke can be obtained in accordance with difference T2 between the respective heights of support seat 27 and center projection 32. After the switch is turned on, moreover, conductor member 30 is pressed against fixed electrodes 11 and 12, with a substantially regular force, by the resilience of second cup section 28, wit the result that the electrical output is not subject to fluctuations in the switch on-off boundary region.

Figure 8:
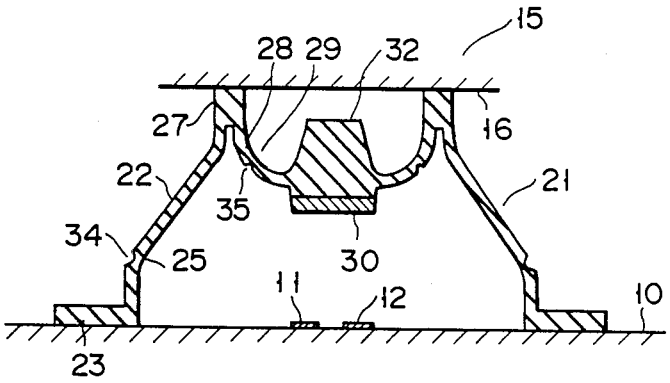
FIG. 8 is a sectional view of a rubber spring according to a second embodiment of the invention.
Figure 9:
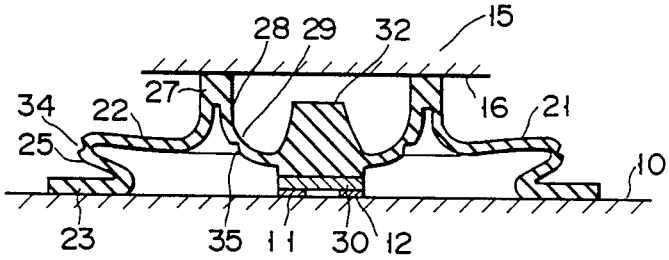
FIGS. 9 and 10 are sectional views showing different operating states of the rubber spring shown in FIG. 8.
Figure 10:
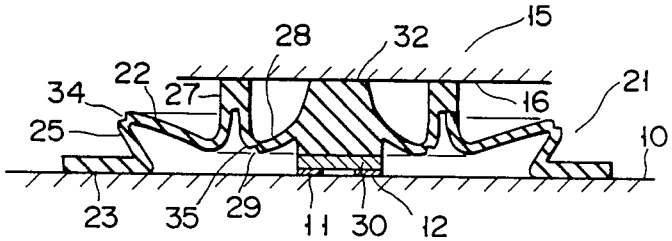

In a second embodiment shown in FIGS. 8, 9, and 10, thin-walled portion 34 is formed at bent portion 25 of first cup section 22. In this case, bent portion 25 can bend more easily, as shown in FIG. 9, so that the resilient restoring force of rubber spring 21 changes more definitely when the peak load is attained. In this way, the feeling of a key click can be clearly sensed when the switch is turned on. Moreover, since thinwalled portion 35 is formed at bent portion 29 of second cup section 28, bent portion 29 can be bent more easily, as shown in FIG. 10.

What is claimed is:

1. A key switch device comprising:

a base formed of electrically insulating material;

a pair of fixed electrodes disposed on the base;

a housing mounted on the base and enclosing the fixed electrodes;

a movable electric conductor member located within the housing and opposing the fixed electrodes, whereby an electric current may flow between the fixed electrodes when said conductor member contacts the fixed electrodes;

a plunger supported by the housing for movement in a vertical direction, and having a horizontal plate section;

a key top mounted on the plunger; and a rubber spring formed of an integral elastomeric molding and contained in the housing, said rubber spring including:

(a) a first cup section in the form of an inverted cup having: a top portion, a ring-shaped support seat located at the top portion and in contact with a lower surface of the plate section of the plunger, a bottom portion which is larger in diameter than the top portion, and a first bent portion located between the top portion and the bottom portion, said first bent portion being pressed and bent by the plate section of the plunger until the movable electric conductor member contacts the fixed electrodes, and said first cup section having a load-stroke characteristic producing a resilient restoring force which increases until said first bent portion is bent to a predetermined degree, and which begins to decrease after the first bent portion is bent to the predetermined degree;

(b) a second cup section located inside the first cup section so as to be continuous with the support seat and having a U-shaped longitudinal section, said second cup section including a second bent portion which is bent, after the movable electric conductor member contacts the fixed electrodes, by the support seat of the first cup section lowered by the plate section of the plunger, said second cup section having a load-stroke characteristic producing a resilient restoring force which increases until said second bent portion is bent to a predetermined degree, and which begins to decrease after the second bent portion is bent to the predetermined degree, whereby said resilient restoring force of the second cup section presses the movable electric conductor member against the fixed electrodes with a substantially constant force after the movable electric conductor member contacts the fixed electrodes;

(c) a lower center projection protruding downward from the center of a lower surface of the second cup section, said movable electric conductor member being attached to a lower face of the projection such that the movable electric conductor member faces the fixed electrodes;

(d) an upper center projection protruding upward from the center of an upper surface of the second cup section, said upper center projection having a length in the direction of movement greater than that of said lower center projection and comprising a top face which is located below the support seat, said top face being at the same level as the support seat and being in contact with the plate section of the plunger when said first and second cup sections are bent to a predetermined degree, the length of said upper center projection in the direction of movement of said plunger being determined such that said upper center projection can continue to press the movable electric conductor member against the fixed electrodes while the plunger is kept pressed downward after the plate section of the plunger contacts the upper surface of the upper center projection.

2. The key switch device according to claim 1 wherein the distance from the fixed electrodes to the conductor member ranges from 2.0 to 3.0 mm when the key top is not depressed, and the difference between the respective lengths in the direction of movement of the support seat and the upper center projection is at least 0.9 mm.

3. The key switch device according to claim 1, wherein said first bent portion includes a thin-walled portion thinner than any other part thereof.

4. The key switch device according to claim 1, wherein said second bent portion includes a thin-walled portion thinner than any other part thereof.

* * * * *